US006789517B2

(12) United States Patent
Romblom et al.

(10) Patent No.: US 6,789,517 B2
(45) Date of Patent: Sep. 14, 2004

(54) METHOD FOR MANAGING THERMAL LOAD ON AN ENGINE

(75) Inventors: Edward R. Romblom, Dewitt, MI (US); Jay Tolsma, Grand Ledge, MI (US); Jason T. Davis, Williamston, MI (US)

(73) Assignee: General Motors Corporation, Detroit, MI (US)

( * ) Notice: Subject to any disclaimer, the term of this patent is extended or adjusted under 35 U.S.C. 154(b) by 38 days.

(21) Appl. No.: 09/993,250

(22) Filed: Nov. 19, 2001

(65) Prior Publication Data

US 2003/0094150 A1 May 22, 2003

(51) Int. Cl.[7] ..... F01L 1/34

(52) U.S. Cl. ..... 123/90.15; 123/90.17; 74/568 R

(58) Field of Search ..... 123/90.15, 90.16, 123/90.17, 90.31, 90.27; 74/568 R; 92/121, 122; 464/1, 2, 160

(56) References Cited

U.S. PATENT DOCUMENTS 4,469,056 A * 9/1984 Tourtelot et al. ..... 123/90.16
4,805,571 A * 2/1989 Humphrey ..... 123/316
4,958,606 A * 9/1990 Hitomi et al. ..... 123/316
5,103,779 A * 4/1992 Hare, Sr. ..... 123/90.11
5,123,397 A * 6/1992 Richeson ..... 123/568.14
5,140,955 A * 8/1992 Sono et al. ..... 123/90.15
5,327,858 A * 7/1994 Hausknecht ..... 123/90.12
5,398,502 A * 3/1995 Watanabe ..... 60/284
5,421,296 A * 6/1995 Hitomi et al. ..... 123/184.53
5,427,078 A * 6/1995 Hitomi et al. ..... 123/559.1
5,469,818 A * 11/1995 Yoshioka et al. ..... 123/90.15
5,738,056 A * 4/1998 Mikame et al. ..... 123/90.17
5,937,808 A * 8/1999 Kako et al. ..... 123/90.15
6,000,375 A * 12/1999 Isobe ..... 123/322
6,123,053 A * 9/2000 Hara et al. ..... 123/90.16
6,397,799 B1 * 6/2002 Carbonne ..... 123/90.15
6,397,813 B1 * 6/2002 Han et al. ..... 123/308
6,408,806 B2 * 6/2002 Sugiyama et al. ..... 123/90.15
6,494,173 B2 * 12/2002 Takahashi et al. ..... 123/90.15

* cited by examiner

*Primary Examiner*—Thomas Denion
*Assistant Examiner*—Jaime Corrigan
(74) *Attorney, Agent, or Firm*—Karl F. Barr, Jr., Esq.; Linda M. Deschere, Esq.

(57) ABSTRACT

A method for adjusting the timing of an internal combustion engine having a crankshaft and a camshaft to manage the thermal load on the engine. The method includes the step of altering the timing of the camshaft with respect to the timing of the crankshaft to reduce thermal load on the engine. Preferably, the step of altering the timing of the camshaft is accomplished with a variable camshaft phaser.

11 Claims, 5 Drawing Sheets

METHOD FOR MANAGING THERMAL LOAD ON AN ENGINE

FIELD OF THE INVENTION

The present invention relates generally to a method for managing the thermal load on an internal combustion engine, and more particularly to a method for selectively altering the output horsepower of the internal combustion engine by adjusting the timing of a camshaft relative to the crankshaft.

BACKGROUND OF THE INVENTION

Internal combustion engines are continuously subjected to thermal loads that are a product of the combustion process and its inherent inefficiencies. Excessive thermal loads can reduce engine efficiency and reliability, which may cause thermal damage to engine components. It may be necessary to use increased flow rate/capacity fuel injectors to lower the temperatures of the thermally affected engine components. Increased flow capacity fuel injectors, however, have the undesirable characteristic of exhibiting decreased fuel control at low load conditions, which may diminish catalytic converter efficiency and increase the amount of precious metals that are needed to manufacture the converter.

The thermal load on an internal combustion engine is directly proportional to the horsepower that is produced by the engine. The largest thermal loads typically occur while the engine is producing maximum horsepower. However, because there is a time delay between the onset of a high thermal load and its potentially damaging effects, an engine can typically withstand a potentially damaging thermal load for a period of time before experiencing a significant reduction in engine performance or damage to its components. Consequently, excessive thermal load is primarily a concern when an engine is operated at high horsepower for an extended period of time.

Since the thermal load on an engine is directly proportional to the horsepower that is generated, one method for reducing excessive thermal loads is to derate the engine, which limits the maximum horsepower that the engine can produce throughout its operating range. Although doing so would certainly reduce the thermal load on the engine, it will also unnecessarily limit the horsepower available at operating conditions that normally do not produce excessive thermal loads. Consequently, it would be desirable to selectively reduce an engine's output only under those conditions in which an engine is likely to be subjected to an excessive thermal load.

Known methods for selectively reducing the thermal load on an engine consist of retarding spark advance and/or increasing an engine's fuel/air mixture. Both of these methods, however, have limited effectiveness in reducing the horsepower produced by an engine and may not be capable of sufficiently reducing the thermal load on an engine at all operating conditions. Accordingly, there is a need for selectively reducing the horsepower output of an engine beyond that which can be achieved by merely adjusting spark advance and the fuel/air mixture.

SUMMARY OF THE INVENTION

The present invention is directed to a method for selectively adjusting the horsepower generated by an internal combustion engine to reduce the thermal load on the engine by adjusting the timing of a camshaft relative to a crankshaft. For a given engine operating condition, there is typically an optimum camshaft phase angle (i.e., timing) that will maximize engine performance. Operating the engine with its camshaft phase angle set to something other than its optimum degrades engine performance and reduces the horsepower output of the engine. The reduced horsepower produces a corresponding decrease in the thermal load on the engine.

In another feature of the invention, a camshaft phaser is used to adjust the timing of the camshaft. The camshaft phaser varies the phase angle of the camshaft relative to the phase angle of the crankshaft. An engine controller, utilizing a control algorithm, controls the operation of the camshaft phaser. The present invention incorporates additional functions in the control algorithm that modify the timing of the camshaft to control the thermal load on the engine.

The camshaft phaser is used to selectively adjust the timing of the exhaust camshaft relative to the timing of the crankshaft. Setting the exhaust camshaft phase angle to something other than its optimum degrades the volumetric efficiency of the engine and reduces the horsepower output of the engine. Moreover, the drop in horsepower produces a corresponding reduction in the thermal load on the engine.

In another feature, the camshaft phaser is used to selectively adjust the timing of an intake camshaft relative to the crankshaft. As is the case with the exhaust camshaft, de-optimizing the timing of the intake camshaft decreases engine performance and horsepower output, which in turn produces a corresponding reduction in the thermal load to the engine.

In yet another feature, two separate camshaft phasers, one attached to the exhaust camshaft, the other to the intake camshaft, simultaneously adjust the timing of both camshafts relative to the crankshaft. Adjusting both camshafts simultaneously allows for a greater reduction in the thermal load to the engine than is possible by only adjusting the timing of one or the other.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The various features, advantages and other uses of the present invention will become more apparent by referring to the following detailed description and accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
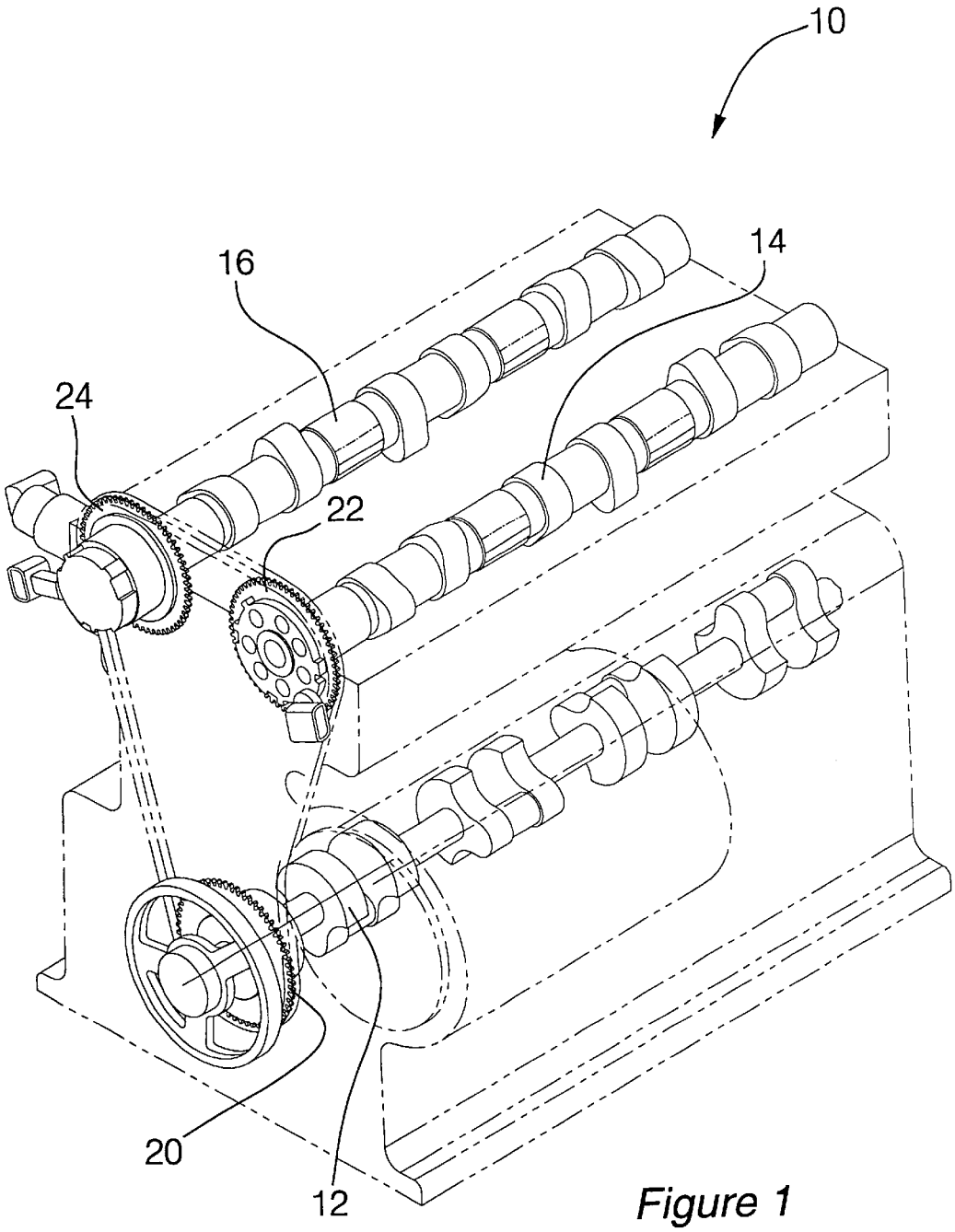
FIG. 1 is a perspective view of an internal combustion engine having a crankshaft, an intake camshaft, an exhaust camshaft, and an exhaust camshaft phaser.

FIG. 1 is a perspective view of an internal combustion engine 10 having a crankshaft 12, an intake camshaft 14, and an exhaust camshaft 16. Attached to the exhaust camshaft 16 is a camshaft phaser 18 of a type known to those skilled in the art. Although persons skilled in the art will appreciate that alternatives may exist for controlling the phase angle of the exhaust camshaft, the present exemplary system preferably utilizes a camshaft phaser that can be controlled to continuously adjust the phase angle of the exhaust camshaft 16. The camshaft phaser 18 adjusts the phase angle of the exhaust camshaft 16 in response to certain predetermined engine parameters.

Sprockets 20, 22, and 24, which are conventional in design, are attached to one end of the crankshaft 12, the intake camshaft 14, and the camshaft phaser 18, respectively. The intake camshaft 14, exhaust camshaft 16, and crankshaft 12, are coupled together in a conventional manner by entraining a belt or chain (not shown) about sprockets 20, 22, and 24, thereby establishing the initial timing sequence between the intake camshaft 14, exhaust camshaft 16, and crankshaft 12.

Figure 2:
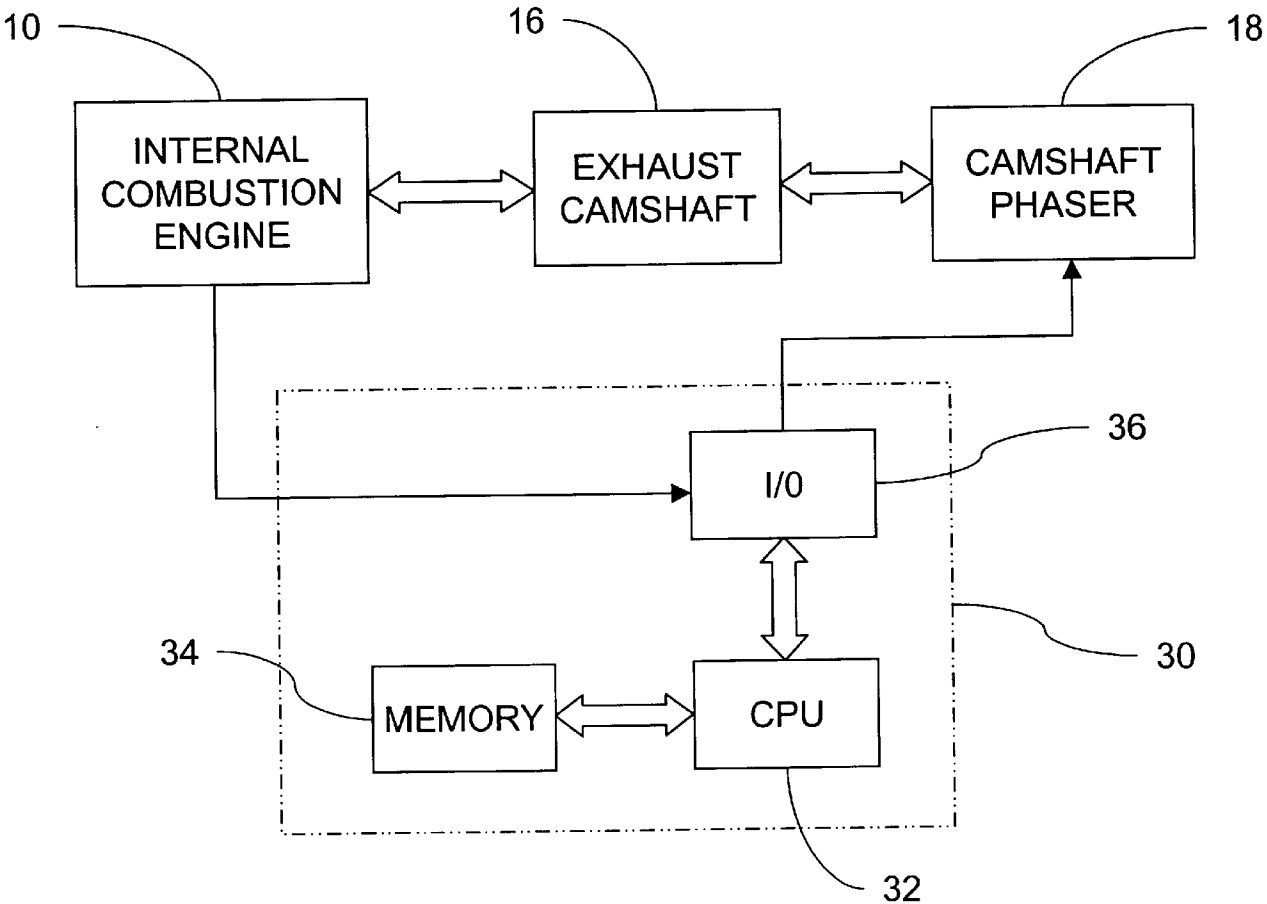
FIG. 2 is a block diagram of the control elements used to carry out the present invention.

Referring to FIG. 2, during normal engine operation, the camshaft phaser 18 adjusts, if necessary, the phase angle between the exhaust camshaft 16 and the crankshaft 12 to achieve a desired engine performance for a given operating condition. An engine controller 30 controls the operation of the camshaft phaser 18. As is conventional, the controller 30 includes a central processing unit (CPU) 32 that executes a control algorithm stored in the controller's memory 34.

Figure 3:
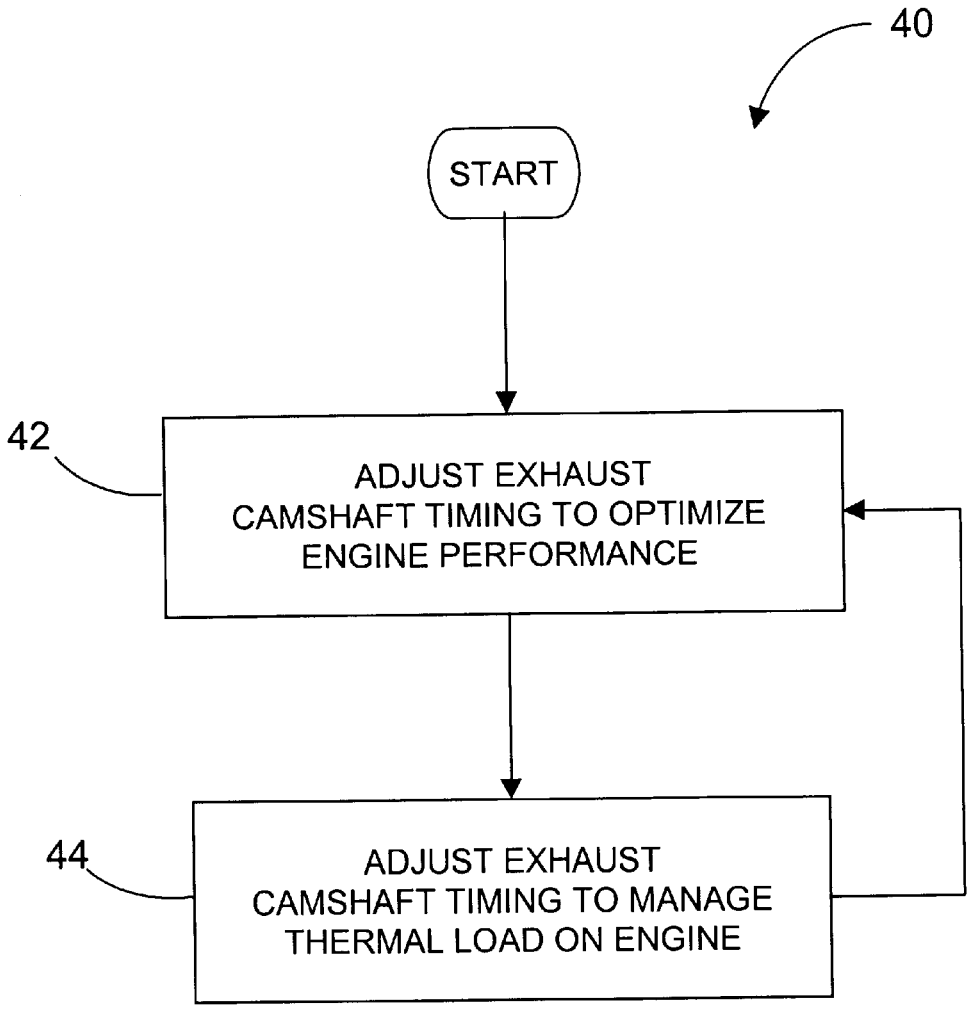
FIG. 3 is a flowchart illustrating the control method of the present invention.

Referring now to FIG. 3, a flow chart is shown for a method 40 used to adjust the timing of crankshaft 12 and exhaust camshaft 16 of engine 10 in accordance with the present invention. Method 40 includes a first step 42 that adjusts the timing of the exhaust camshaft 16 with respect to the crankshaft 12 to optimize engine performance. A second step 44 adjusts, if necessary, the exhaust camshaft phase angle that was previously calculated in step 42 to manage the thermal load on engine 10. The control algorithm, which is designed to optimize engine performance as well as protect the engine from excessive thermal load, controls when and by how much the camshaft timing is altered. The control algorithm is stored in memory 34 of engine controller 30. Adjustments to the exhaust camshaft timing are made while engine 10 is operating.

The exhaust camshaft phaser 18 is activated in response to one or more predetermined engine parameters that are monitored by the control algorithm. According to a preferred embodiment, the predetermined engine parameters include at least one parameter selected from the currently chosen transmission gear, TCC, barometric pressure, coolant temperature, engine RPM, manifold pressure, engine intake air temperature, and the amount of time engine 10 has operated in a "power enrichment" mode. Power enrichment is a known method for increasing the horsepower output of an engine during high load conditions by increasing the engine's fuel/air mixture.

Figure 4:
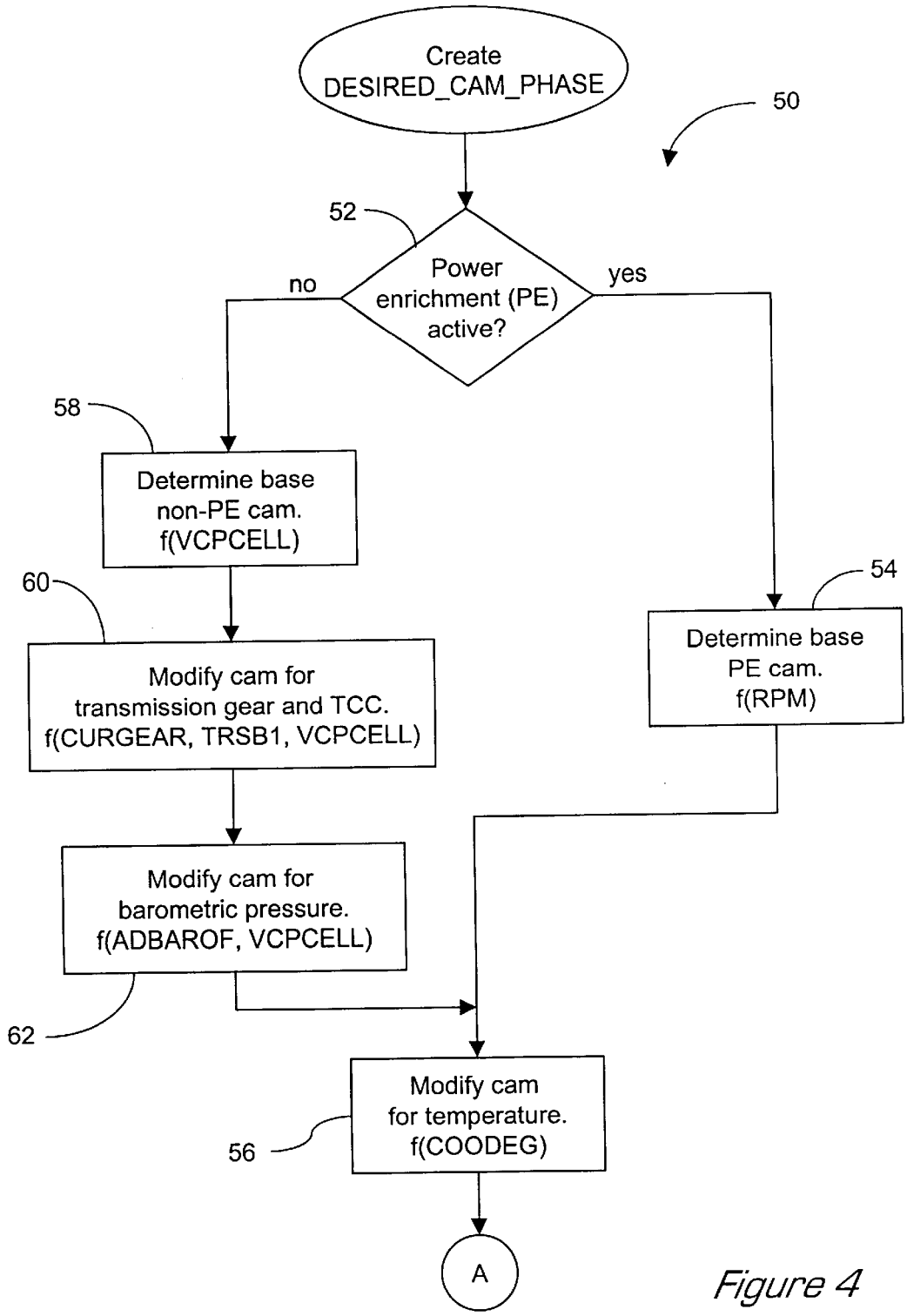
FIG. 4 is a flowchart illustrating a method for adjusting the exhaust camshaft timing to optimize engine performance.

Referring to FIG. 4, a block diagram flow chart is shown depicting a method 50 used by the control algorithm to determine the exhaust camshaft phase angle required to optimize engine performance based on the current engine operating condition. Method 50 is a more detailed description of step 42 of method 40 (see FIG. 3), whereby the exhaust camshaft timing is adjusted to optimize engine performance. In step 52 of method 50, the control algorithm determines whether the engine's power enrichment (PE) mode has been activated. As previously noted, power enrichment is initiated when an engine is under high load and additional horsepower is needed. The additional horsepower is obtained by raising the engine's fuel/air mixture. Changing the fuel/air mixture also requires that a corresponding adjustment be made to the exhaust camshaft timing. If power enrichment is activated, the control algorithm proceeds to step 54 where it calculates a base PE exhaust phase angle as a function of engine RPM. This calculation can be accomplished via a look-up table, an algorithm or other suitable methods.

The optimum exhaust camshaft phase angle can also be dependant on the engine coolant and/or engine inlet air temperature. In step 56 the control algorithm adjusts the base PE exhaust phase angle calculated in step 54 to account for the affect of the current engine coolant and/or engine inlet air temperature. Preferably, a look-up table provides a correction factor that is added to or subtracted from the base PE exhaust phase angle determined in step 54.

If the power enrichment mode is not activated, the control algorithm proceeds from decision block 52 to step 58, where it calculates a base non-power enrichment (non-PE) exhaust camshaft phase angle. The base non-power enrichment exhaust camshaft phase angle is further adjusted based on certain vehicle operating parameters, which may include the transmission gear that is currently selected (step 60) and the barometric pressure (step 62). For each case, the control system has predetermined phase angle correction factors that are combined with the base non-PE exhaust phase angle to optimize engine performance. As is the case when the power enrichment mode is activated, step 56 is performed to adjust the corrected base non-PE phase angle to take into account the affect of engine coolant temperature. The output from step 56 is an optimum exhaust camshaft phase angle determination.

Figure 5:
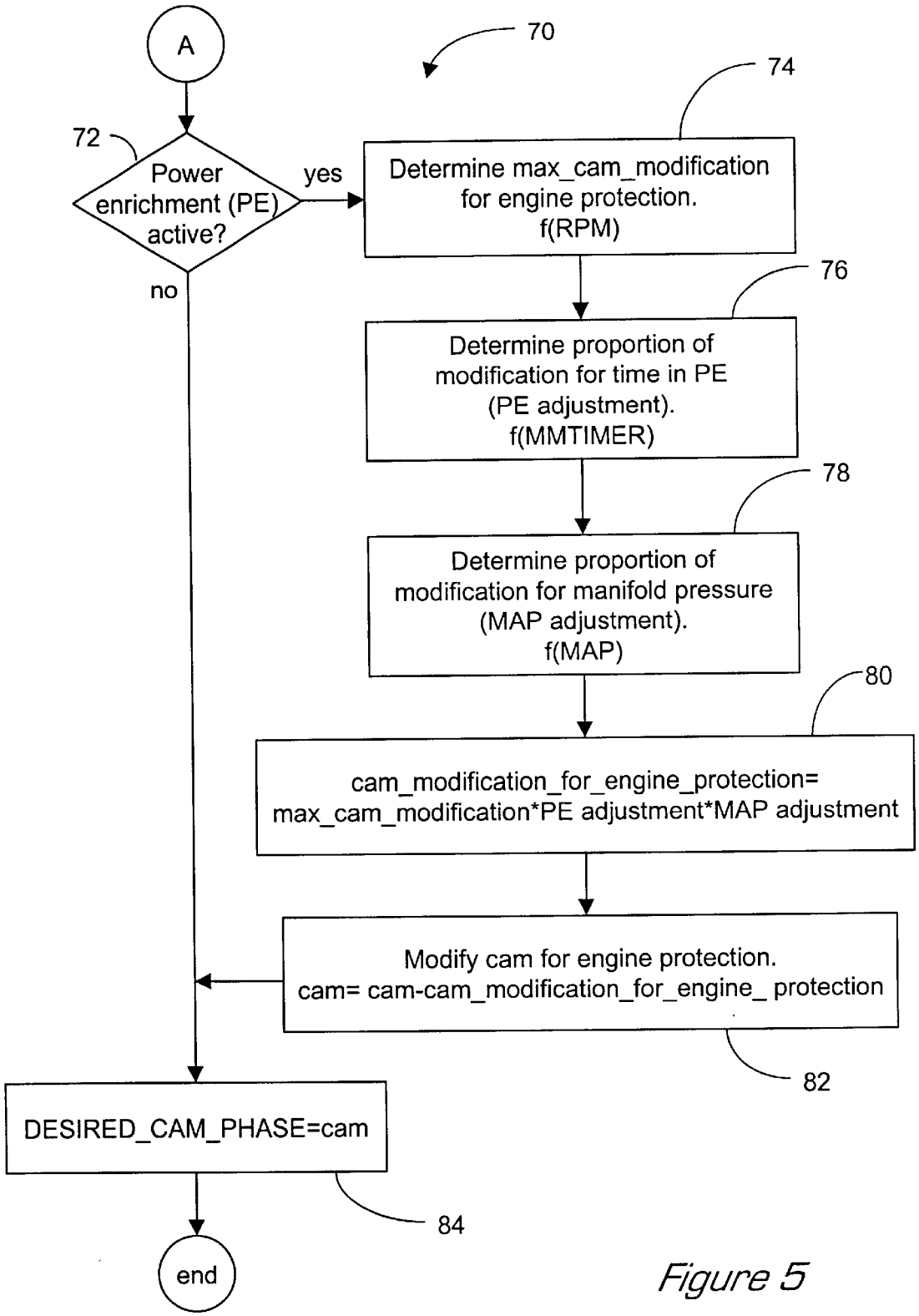
FIG. 5 is a flowchart depicting a method for adjusting the exhaust camshaft timing to manage the thermal load on the engine.

Referring now to FIG. 5, a flow chart is shown depicting a method 70 used to calculate the exhaust camshaft phase angle that reduces, when required, the horsepower output of the engine to manage the engine's thermal load. The control algorithm uses method 70 in conjunction with method 50 (see FIG. 4) to determine the proper exhaust camshaft phase angle. Method 70 is a more detailed description of step 44 of method 40 (see FIG. 3), whereby the optimized exhaust camshaft timing is adjusted to manage engine performance. It is important to note that method 70 is a continuation of method 50, and the two methods operate in conjunction with one another to determine the proper exhaust camshaft phase angle for a given engine operating condition.

In step 72 of method 70, the control algorithm first determines whether the power enrichment mode is activated. Method 70 uses the status of the power enrichment mode as the decisional operator since excessive thermal loads generally occur when power enrichment is activated and engine 10 is producing high horsepower. If the power enrichment mode is activated, the control algorithm sequentially executes steps 74 through 82 of method 70 and calculates the exhaust camshaft phase angle required to reduce the thermal load on the engine. If on the other hand, the power enrichment mode is not activated, the control algorithm will skip steps 74 through 82 and proceed directly to step 84.

If engine 10 is operating in the power enrichment mode, the control algorithm will execute step 74 and calculate the maximum adjustment that can be made to the exhaust cam phase angle to manage the thermal load on the engine (maximum adjustable phase angle). The maximum adjustable phase angle varies depending on engine RPM and the configuration of the engine. The relationship between the maximum adjustable phase angle and engine RPM is typically determined empirically. The resulting data is included in a look-up table that can be accessed by the control algorithm. The control algorithm references the lookup table to determine the maximum adjustable phase angle as a function of engine RPM.

In step 76, the control algorithm monitors the amount of time the engine has continuously operated with the power enrichment mode active. Since various engine components do not reach their maximum temperature immediately upon initiation of power enrichment, adjustments to the exhaust camshaft timing as a means for offsetting the increased thermal load may occur over a period of time. The actual time period, however, varies depending on the particular engine component involved as well as the overall engine configuration. The transient temperature characteristics for a given engine component are typically determined empirically. The resulting data is incorporated into a lookup table that can be accessed by the control algorithm. The control algorithm references the table to determine the amount by which to adjust the maximum adjustable phase angle based on the length of time the engine has continuously operated in the power enrichment mode.

The exhaust camshaft timing required to manage the thermal load on an engine is also a function of the engine's manifold pressure (MAP). There is a direct correlation between the horsepower that an engine is producing and MAP. Furthermore, the thermal load on an engine is directly proportional to the horsepower being produced by the engine. Since there is a direct correlation between MAP and horsepower, as well as between horsepower and thermal load, it follows that there is also a direct relationship between MAP and thermal load. Consequently, MAP can be used to accurately estimate the magnitude of the thermal load on the engine. The relationship between horsepower output (which is directly proportional to the thermal load) and MAP is typically determined empirically and varies depending on the particular engine configuration. The resulting data is incorporated into a lookup table that can be accessed by the control algorithm. Referring to FIG. 5, in step 78 the control algorithm references the lookup table to determine the amount by which the previously calculated maximum adjustable phase angle can be reduced based on the amount of horsepower the engine is producing.

Continuing to refer to FIG. 5, using the results of steps 74, 76 and 78, in step 80 the control algorithm calculates the amount of adjustment that needs to be made to the exhaust camshaft phase angle that was previously determined using method 50. In step 82 the control algorithm calculates the exhaust camshaft phase angle that balances the desire to optimize engine performance with the need to appropriately manage the thermal load on the engine. The optimum exhaust camshaft phase angle is arrived at by subtracting the result of step 80 from the exhaust camshaft phase angle determined in step 56 of method 50. The resulting camshaft phase angle information is then processed by controller 30 for communication to the power-operated actuator associated with the camshaft phaser 18 via a conventional I/O interface 36. The camshaft phaser 18 then makes the necessary adjustment to the timing of the exhaust camshaft 16.

In another preferred embodiment of the present invention, the camshaft phaser 18 is used to selectively adjust the timing of the intake camshaft 14 relative to the crankshaft 12. As is the case with the exhaust camshaft 16, de-optimizing the timing of the intake camshaft 14 will decrease the performance and horsepower output of engine 10, which will result in a corresponding decrease in the thermal load to the engine. In this embodiment, the camshaft phaser 18 is attached to intake camshaft 14, rather than the exhaust camshaft 16. The engine controller 30, shown in FIG. 2, still controls the operation of the camshaft phaser 18, but the camshaft phaser now controls the timing of the intake camshaft 14, rather than the exhaust camshaft 16. Determining the appropriate intake camshaft phase angle is accomplished using the previously described method for determining the phase angle of the exhaust camshaft, which is also shown in FIGS. 3 through 5.

In yet another embodiment of the present invention, two separate camshaft phasers 18 are used to simultaneously adjust the timing of both the intake camshaft 14 and the exhaust camshaft 16 relative to the crankshaft 12. In this embodiment, a separate camshaft phaser 18 is attached to the intake camshaft 14 and the exhaust camshaft 16. The engine controller 30, shown in FIG. 2, controls the operation of both camshaft phasers 18. Once again, determining the appropriate intake and exhaust camshaft phase angles is accomplished using the previously described method for determining the phase angle of the exhaust camshaft, which is also shown in FIGS. 3 through 5.

While the invention has been described in the specification and illustrated in the drawings with reference to a preferred embodiment, it shall be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but rather, the invention will include any embodiments falling within the description of the appended claims.

What is claimed is:

1. A method for adjusting the timing of an internal combustion engine having a crankshaft and a camshaft, comprising the steps of:

altering the timing of the camshaft with respect to the crankshaft to optimize engine performance;

determining if the engine is operating in a power enriched mode by comparing a currently delivered fuel/air mixture to a predetermined fuel/air mixture;

altering the timing of the camshaft with respect to the crankshaft from the previously optimized position to adjust engine performance in response to the engine entering the power enrichment mode;

determining the amount of time the engine has continuously operated within the power enrichment mode; and altering the timing of the camshaft with respect to the crankshaft from the previously altered position to reduce the thermal load on the engine.

2. The method of claim 1 wherein the step of altering the timing of at least one camshaft further comprises performing at least one of advancing and retarding the timing of at least one camshaft relative to the crankshaft to optimize engine performance and reduce the thermal load on the engine.

3. The method of claim 2 wherein the step of performing at least one of advancing and retarding the timing of at least one camshaft further comprises performing at least one of advancing and retarding the timing of at least one camshaft relative to the crankshaft within a range of zero to twenty-five degrees inclusive.

4. The method of claim 1 wherein the step of altering the timing of at least one camshaft further comprises the step of altering the timing of at least one camshaft with at least one camshaft phaser.

5. The method of claim 4 wherein the step of altering the timing of at least one camshaft further comprises activating at least one camshaft phaser in response to at least one predetermined engine parameter.

6. The method of claim 5 wherein the predetermined engine parameters include at least one parameter selected from engine speed, engine load, power enrichment, the currently selected transmission gear, TOG, barometric pressure, engine coolant temperature, engine inlet air temperature, manifold pressure, and the amount of time the engine has operated in a power enrichment mode.

7. The method claim 1 wherein the step of altering the timing of at least one camshaft further comprises altering the timing of at least one camshaft relative to the crankshaft in response to at least one predetermined engine parameter.

8. The method of claim 7 wherein the predetermined engine parameters include at least one parameter selected from engine speed, engine load, power enrichment, the currently selected transmission gear, TCC, barometric pressure, engine coolant temperature, engine inlet air temperature, manifold pressure, and the amount of time the engine has operated in a power enrichment mode.

9. The method of claim 1 wherein at least one camshaft is an exhaust camshaft and the step of altering the timing of at least one camshaft further comprises altering the timing of at least one exhaust camshaft relative to the crankshaft.

10. The method of claim 1 wherein at least one camshaft is an intake camshaft and the step of altering the timing of at least one camshaft further comprises altering the timing of at least one intake camshaft relative to the crankshaft.

11. The method of claim 1 wherein at least one camshaft is an intake camshaft and at least one other camshaft is an exhaust camshaft, and the step of altering the timing of at least one camshaft further comprises altering the timing of at least one intake camshaft and at least one exhaust camshaft relative to the crankshaft.

* * * * *